United States Patent [19]

Weber

[11] Patent Number: 4,583,461

[45] Date of Patent: Apr. 22, 1986

[54] METHOD FOR ATTACKING OF TARGET OBJECTS WITH SMALL BOMBS AND A SMALL BOMB-CARRIER FOR IMPLEMENTING THE METHOD

[75] Inventor: Adolf Weber, Neunkirchen, Fed. Rep. of Germany

[73] Assignee: Diehl GmbH & Co., Fed. Rep. of Germany

[21] Appl. No.: 614,742

[22] Filed: May 25, 1984

[30] Foreign Application Priority Data

Jun. 1, 1983 [DE] Fed. Rep. of Germany ..... 3319824

[51] Int. Cl.[4] ..... F42B 13/50; F41G 9/02; F42C 19/04

[52] U.S. Cl. ..... 102/489; 102/211; 102/212; 102/213; 102/214; 102/393

[58] Field of Search ..... 102/489, 499, 393, 396, 102/384, 214, 212, 213; 244/3.16; 89/1.11

[56] References Cited

U.S. PATENT DOCUMENTS

| | | | |
|---|---|---|---|
| 3,611,931 | 10/1971 | Bessey et al. | 102/393 |
| 3,726,223 | 4/1973 | Moe | 102/490 X |
| 4,072,107 | 2/1978 | Saxe et al. | 102/388 |
| 4,128,836 | 12/1978 | Ramos et al. | 102/214 X |
| 4,157,068 | 6/1979 | Rognmo | 102/489 |
| 4,185,560 | 1/1980 | Levine | 102/214 |
| 4,320,703 | 3/1982 | Abadie et al. | 102/214 |
| 4,444,117 | 4/1984 | Mitchell | 102/489 |
| 4,455,943 | 6/1984 | Pinson | 102/489 |

FOREIGN PATENT DOCUMENTS 2364195 6/1975 Fed. Rep. of Germany .

OTHER PUBLICATIONS

"Military Microwaves '82"; Microwave Exhibitions & Pub. Ltd.; pp. 133–140, Oct. 20–22, 1982.

*Primary Examiner*—David H. Brown

*Attorney, Agent, or Firm*—Scully, Scott, Murphy & Presser

[57] ABSTRACT

A method for the attacking of target objects through the intermediary of small bombs which are ejected from a carrier or canister in the longitudinal axial direction of the latter. The small bomb-carrier or canister includes a controllably ignitable ejector propellent charge for the ejection of small bombs in parallel with the longitudinal axis thereof upon reaching of a predetermined drop height during falling into a target area. The ejection of the small bombs is delayed until the reaching of a height above ground which is reduced relative to a reference of standard height, when prior to the reaching of the standard height there is detected a target object within a surface area corresponding to a smaller dispersing and target area.

7 Claims, 2 Drawing Figures

METHOD FOR ATTACKING OF TARGET OBJECTS WITH SMALL BOMBS AND A SMALL BOMB-CARRIER FOR IMPLEMENTING THE METHOD

BACKGROUND OF THE INVENTION

1. Field of the Invention

The present invention relates to a method for the attacking of target objects through the intermediary of small bombs which are ejected from a carrier or canister in the longitudinal axial direction of the latter, and moreover, relates to a small bomb-carrier or canister with a controllably ignitable ejector propellent charge for the ejection of small bombs in parallel with the longitudinal axis thereof upon reaching of a predetermined drop height during falling into a target area.

2. Discussion of the Prior Art

A method and arrangement of the kind as referred to herein has become known from the disclosure of German Published Patent Application No. 17 03 781. The ignition of the ejector propellent charge must be carried out at such a height above ground so that the small bombs or bomblets which are expelled towards the rear from tne carrier, essentially in parallel with the direction of falling into the target area, whose steep flight into the target area is imparted a mutual fan-shaped spreading apart, and cover a sufficiently large dispersing surface and, as a result, target surface; whereas, on the other hand, for a target area with an exceedingly large surface area, because of the limited number of small bombs contained within a carrier or canister, the probability of direct hits on target objects operating individually within the target area is relatively low.

SUMMARY OF THE INVENTION

Accordingly, it is an object of the present invention to enhance upon the effect of attacks on individual target objects with small bombs within a targe area.

The foregoing object is inventively achieved through the method of the type described for attacking of target objects wherein, during the fall of the carrier into a target area, the ejection of the small bombs is delayed until the reaching of a height above ground which is reduced relative to a reference of standard height, when prior to the reaching of the standard height there is detected a target object within a surface area corresponding to a smaller dispersing and target area.

Furthermore, it is also an object of the present invention to provide a carrier or canister for small bombs of the type described, in which a sensor is built into the carrier whose area or range of detection at a detecting height above ground is substantially less than that of the target area for a bomb ejection at a standard height above ground, and wherein upon the detecting of a predetermined target object within its detection area, prior to reaching the standard height, the ejector propellent charge will not yet ignite at the standard height but only first at a reduced height or elevation above ground for a correspondingly smaller, inner target area which generally conforms with the sensor detection area from the detecting height above the standard height above ground.

The underlying concept of the inventive object can thus be ascertained in that the carrier or canister is not only equipped with a sensor for the altitude-dependent control for the ignition of the ejector propellent charge; but there is also provided for this sensor, or additionally thereto a further sensor such that, prior to the dropping down of the carrier to the standard height for the ejection of the small bombs, to investigate an inner region of the target area for the purpose as to whether there is located therein a specific or predetermined target object which is to be attacked. When this is the case, then the ejection of the small bombs does not take place at the standard height above ground, but is delayed; and thereby, only upon reaching of a reduced height from which the small bomb dispersion area is essentially concentrated on the smaller area determined by the sensor interiorly of the larger standard target area. In this instance, the effect of the utilization of small bombs is enhanced, since the individual effects thereof are concentrated over a decreased target area and thereby in close proximity to a specific target object which is to be attacked; with the result of a correspondingly increased probability of the successful employment of the small bomb carrier. When in contrast therewith, during the falling into the target area there is not detected any specific target object which is to be attacked by the sensor within that inner target area; then the ejection of the small bombs is effected in an undelayed manner; thus, upon reaching of the standard height with the correspondingly greater dispersing region about the inner target area in which there is provided the normal probability of direct bomb hits on target objects which are located outside the area of detection by the sensor.

As the carrier or canister there can be utilized, in the same manner, the warhead of a cruise missile or a ballistic projectile, when by means of its ballistic or controlled trajectory there is imparted a sufficiently steep fall of the carrier into the target area. In accordance therewith, the small bombs allow themselves to be simply concentrated over the decreased surface area within the target area, in that (at a timely detection of a target object located therein which is to be specifically attacked) the small bomb ejection is delayed up to the reaching of a lower height above target ground. Moreover, the constructive requirement for the assembly and operation of the sensor is then relatively low, inasmuch as this can be built in fixedly and oriented along the carrier longitudinal axis into the nose cone of the latter.

The sensor can also be constructed simply and inexpensively, since it requires neither a high resolution nor intensive focusing. Contrastingly, it is sufficient for the sought after improvement of the small bomb utilization, in that it covers a detection area on the ground from closely above the standard ejection height, and which is smaller than the standard dispersion area for the small bombs.

BRIEF DESCRIPTION OF THE DRAWINGS

Reference may now be had to the following detailed description of an exemplary embodiment of the invention elucidating further features and advantages thereof, taken in conjunction with the accompanying drawings which is limited to a diagrammatically represented arrangement for the implementation of the inventive process; in which.

DETAILED DESCRIPTION

Figure 1:
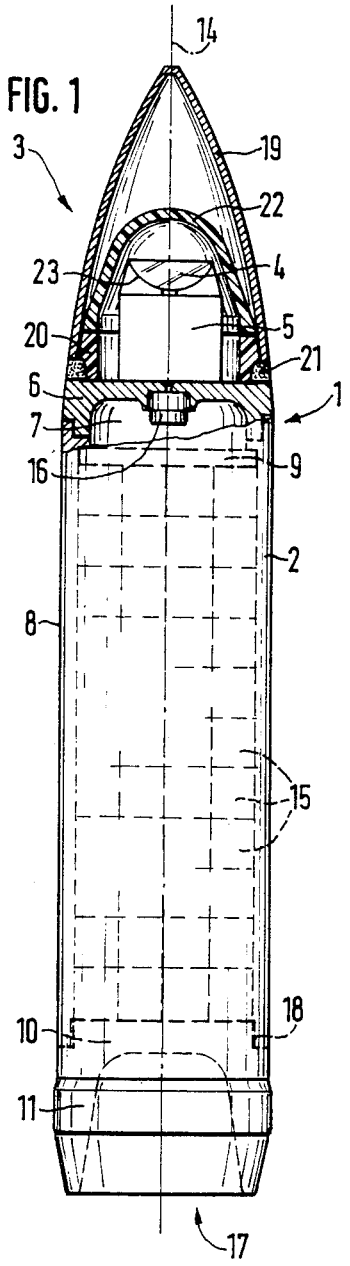
FIG. 1 illustrates a projectile forming a small bomb-carrier, shown partly in cross-section.

Illustrated in FIG. 1 of the drawings, a small-bomb carrier is in the form of a projectile 2 which can be fired from a barreled weapon. The carrier consists of a projectile tip 3 with a sensor 4 and an electronic signal processing device 5, an intermediate portion 6 with an ejector propellent charge 7, a projectile shell casing 8 with an ejector plate 9, as well as a projectile base 10 with a guide band 11.

Figure 2:
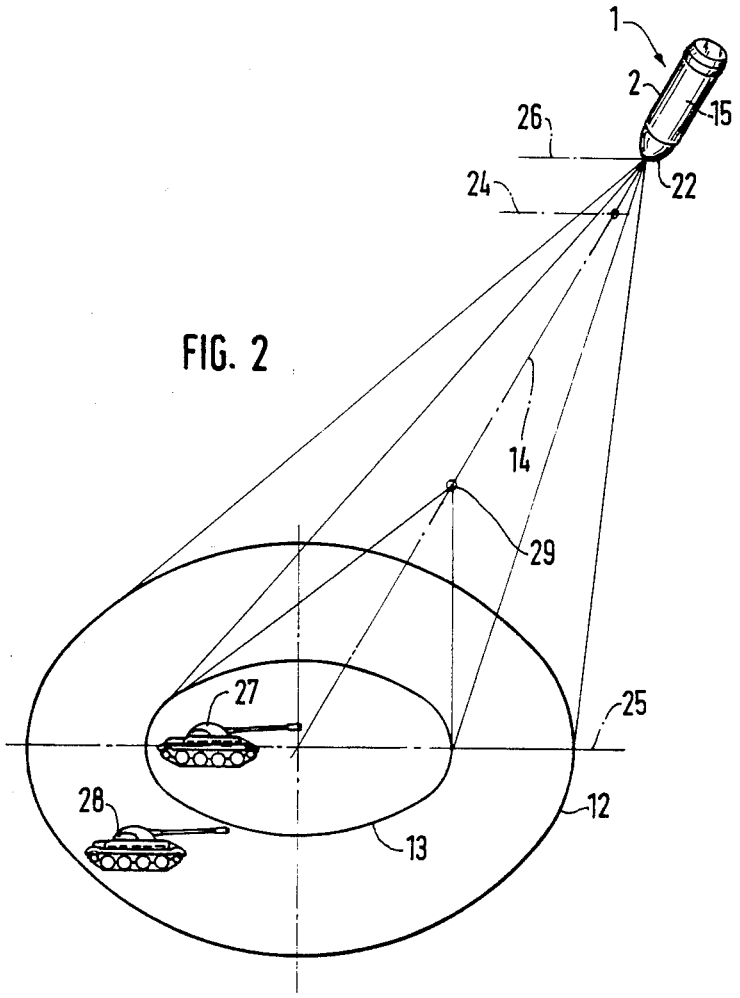
FIG. 2 illustrates the carrier after the blowing off of its outer nose cone during steep approach towards the target ground.

The small bombs 15 which are to be conveyed by the projectile 2 over the target area 12, 13 (FIG. 2) and there expelled in the direction of the longitudinal axis of the projectile 14 and opposite the flying direction of the projectile, are arranged in the projectile casing 8 intermediate the ejector plate 9 and the base 10; in essence, arranged strand-like in series and packed concentrically about the longitudinal axis 14 of the projectile. For effecting the expulsion of the small bombs 15, a triggering device 16 arranged in the intermediate portion 6 is actuated by the signal processing device 5, which will ignite the ejector propellent charge 7. The pressure which is, as a consequence, exerted against the ejector plate 9 in a direction acting towards the projectile tail end portion 17, is transmitted to the base 10 through the strand-shaped packing of the small bombs 15, the threaded connection 18 of which with the projectile casing is then sheared through so that the small bomb 15 are forced out through the thus opened projectile tail end portion from the projectile 2 opposite to the flying direction.

The contour of the projectile tip or nose cone 8 is defined by a smooth flow-enhancing outer nose cone 19 configuration of a high-strength material, particularly a material which is based on lightweight metals. The tip is screwed together at its sides with a nose cone socket 20 located at the rear of the projectile tip 3. By means of explosive charges 21 arranged at that location, the outer nose cone 19, controlled from the signal processing device 5, can be burst forwardly away from the socket 20. This will result in the exposure of an inner nose cone 22 which is shaped as a forwardly extending hollow hemisphere, whose geometry material, in accordance with the extent of the electromagnetic radiation which the sensor 4 operates, is designed to maintain distortions and losses, encountered during the passage of radiation through the inner nose cone 22, as low as possible.

Arranged behind the inner nose cone 22 within the projectile tip 3 is the sensor 4, which is preferably formed as a very high frequency-wave parabolic mirror 23 with a central axis located within the longitudinal axis 14 of the projectile. Suitably, constructionally united with the foregoing is the device for the conversion of electromagnetic signals which are received into information which is evaluated by the signal processing device 5 located rearwardly thereof, for initiating the explosive bursting away of the outer nose cone 19 and thereafter for the ejection of the small bombs 15.

The carrier or canister 1 is designed, when required respectively final phase-controlled, to approach the target area in a relatively steep free-falling flight. For the construction and assembly of the sensor 4, as previously mentioned, there need not be employed any special requirements; it is adequate to provide a receiver arrangement which is coaxially and fixedly built into the projectile tip 3 and previously oriented relative thereto, as is generally required by the parabolic mirror 23 for high-frequency waves.

The target area 12 on the ground 25, in accordance with the measure of the fall angle and the flight movements of the carrier 1, represents a time-dependent ovally-distorted circular surface. This surface conforms with the dispersion area over which the small bombs or bomblets 15 will disperse at an ejection at a standard height or elevation 24 of, for example, about 300 meters above ground 25.

Already above this standard height or elevation 24, after the outer nose cone 19 has been burst off, there commences the target detection through the sensor 4; for example, at a detecting height 26 of 400 meters above ground 25. The object of this target detection is the receiving of the reflective or inherent radiation of target objects 27 located within the detection area for the sensor which, on the ground 25, corresponds to an inner, decreased target area, on which the dispersion area of the small bombs 15 can be reduced in that the ejection of the small bombs is delayed until the reaching of a reduced or lower height 29 above ground 25. The small bomb ejection at this lower height 29, due to the decreased dispersion area, provides for a concentration of the small bombs 15 on the inner target area 13, and thereby on the target object 27 located therein, so that almost all small bombs 15 will attack with a high degree of density and the target will, in all probability, be forced out of action or combat. Thus, the effectiveness of utilizing small bombs 15 against target objects 27 can be essentially enhanced in that a simple variant of the sensor technology developed for combat observation and target detection can be employed herein for delaying of the small bomb ejection up to the reaching of a lower height 29 above ground when there is detected within the inner target area 13 a defined target object 27.

When in contrast herewith, in the interior 13 of the entire target area 12 which can be reached by the small bombs 15, there can not be ascertained any specific target object 27 which is to be attacked, whose radiation or geometric parameters are prescribed in the signal processing device 5 for target selection then, as usual, there is effected the ejection of the small bombs already upon reaching the standard height 24, for the dispersing of the small bombs 15 about this standard dispersion area as the normal target area 12. The target objects 28 which are located therein thus cannot be attacked with the high degree of density of all of the small bombs 15; however, there is present the normal probability that by means of at least one of the dispersed small bombs 15 there will be achieved direct hits and there is caused at least some combat effectiveness-reducing damage to the target objects 28.

I claim:

1. In a method for the attacking of target objects through the intermediary of small bombs which are ejected from a carrier in the longitudinal axial direction of said carrier; the improvement comprising delaying ejection of said small bombs from said carrier upon said carrier dropping into a target area until said carrier reaches a lower height relative to a standard height above ground, when before said carrier reaching the standard height, a target object is detected in an area within the target area conforming to a smaller dispersion and target area.

2. In a small bomb-carrier with a controllably-ignitable ejector propellent charge for the ejection of small bombs from said carrier in parallel with the longitudinal axis of said carrier upon reaching of a predetermined drop height above ground during said carrier falling into a target area; the improvement comprising a sensor within said carrier having a detecting area at a detection height which is substantially smaller than the target area small bomb ejection at a standard height; which sensor upon detection of a predetermined target object within its detecting area will, prior to reaching of the standard height above ground, inhibit means for triggering of the ejector propellent charge at the standard height, and to delay said triggering to a lower height above ground for a respectively smaller, inner target area which generally conforms to the sensor target detecting area from the detecting height above the standard height.

3. Carrier as claimed in claim 2, wherein the sensor is arranged within a nose cone of said carrier and extends coaxially forwardly in the longitudinal axial direction of said carrier.

4. Carrier as claimed in claim 2, wherein said sensor includes a high frequency-wave parabolic mirror.

5. Carrier as claimed in claim 2, wherein said carrier comprises a projection configuration.

6. Carrier as claimed in claim 2, wherein said carrier comprises an inner nose cone having a structure correlated with the functioning of said sensor; and an outer nose cone encompassing the inner nose cone, said outer nose cone having an aerodynamically flow-enhancing configuration and being ejectable from said carrier.

7. Carrier as claimed in claim 6, comprising an explosive charge detonable by said sensor for bursting off said outer nose cone responsive to said carrier dropping to a predetermined target detection height above the standard height for bomb ejection.

* * * * *